US010180649B2

(12) United States Patent
Nowak et al.

(10) Patent No.: US 10,180,649 B2
(45) Date of Patent: Jan. 15, 2019

(54) SYSTEMS AND METHODS FOR IMPLEMENTING ELECTROPHOTOGRAPHIC LAYERED MANUFACTURING OF THREE DIMENSIONAL (3D) OBJECTS, PARTS AND COMPONENTS USING TRI-LEVEL ELECTROPHOTOGRAPHY

(71) Applicant: XEROX Corporation, Norwalk, CT (US)

(72) Inventors: Willam J Nowak, Webster, NY (US); Jorge A Alvarez, Webster, NY (US); Paul J McConville, Webster, NY (US); Robert A Clark, Williamston, NY (US); Michael F Zona, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 250 days.

(21) Appl. No.: 14/958,950

(22) Filed: Dec. 4, 2015

(65) Prior Publication Data

US 2017/0160694 A1 Jun. 8, 2017

(51) Int. Cl.

| | |
|---|---|
| ***B05D 1/36*** | (2006.01) |
| ***G03G 15/00*** | (2006.01) |
| ***G03G 15/22*** | (2006.01) |
| ***G03G 15/01*** | (2006.01) |

(52) U.S. Cl.

CPC ..... *G03G 15/6585* (2013.01); *G03G 15/0168* (2013.01); *G03G 15/225* (2013.01)

(58) Field of Classification Search

None

See application file for complete search history.

(56) References Cited

U.S. PATENT DOCUMENTS 5,088,047 A * 2/1992 Bynum ..... B22F 3/1055 156/272.8

5,524,181 A * 6/1996 Sung ..... G03G 15/01 358/1.14

(Continued)

OTHER PUBLICATIONS

Ashok V. Kumar & Anirban Dutta, Electrophotographic Layered Manufacturing, J. Mfg. Science and Eng., 126, 571-76 (Aug. 2004).

*Primary Examiner* — Jason L Lazorcik

(74) *Attorney, Agent, or Firm* — Caesar Rivise, PC

(57) ABSTRACT

A system and method are provided for implementing a unique electrophotographic layered manufacturing scheme for creating higher fidelity electrophotographic composite laminate layers using tri-level electrophotography or electrostatic imaging scheme as a process for rendering individual laminate layers to be built up to form and/or manufacture three-dimensional objects, parts and components as 3D objects. A multi-stage 3D object forming scheme is described involving steps of multi-component laminate forming in a particularized electrophotographic layer forming process. This process renders a part component and a support component precisely next to one another with a single exposure by an exposing device to form a latent image of variable discharge voltages. Multiple toner product sources are used to dispose part component toner and support component toner in the forming of the multi-component laminate layer.

10 Claims, 4 Drawing Sheets

(56) References Cited

U.S. PATENT DOCUMENTS

| | | | | |
|---|---|---|---|---|
| 5,884,119 | A * | 3/1999 | Maruo | G03G 15/011 399/51 |
| 5,893,664 | A * | 4/1999 | Kumasaka | G03G 13/01 399/296 |
| 5,895,738 | A * | 4/1999 | Parker | G03G 15/0152 399/156 |
| 6,066,285 | A * | 5/2000 | Kumar | G03G 15/224 264/317 |
| 6,206,672 | B1 | 3/2001 | Grenda | |
| 6,271,874 | B1 * | 8/2001 | Maruo | H04N 1/508 347/240 |
| 6,376,148 | B1 * | 4/2002 | Liu | B22F 3/008 156/273.1 |
| 8,124,192 | B2 | 2/2012 | Paasche et al. | |
| 8,488,994 | B2 | 7/2013 | Hanson et al. | |
| 8,718,522 | B2 | 5/2014 | Chillscyzn et al. | |
| 8,879,957 | B2 | 11/2014 | Hanon et al. | |
| 2001/0001057 | A1 * | 5/2001 | Melnyk | G03G 5/047 430/57.3 |
| 2002/0145213 | A1 * | 10/2002 | Liu | G03G 15/224 264/40.1 |
| 2002/0149137 | A1 * | 10/2002 | Jang | G03F 7/0037 264/494 |
| 2005/0089348 | A1 * | 4/2005 | Amarakoon | G03G 15/1675 399/297 |
| 2013/0075013 | A1 | 3/2013 | Chillscyzn et al. | |
| 2013/0077996 | A1 | 3/2013 | Hanson et al. | |
| 2013/0186549 | A1 | 7/2013 | Comb et al. | |

* cited by examiner

SYSTEMS AND METHODS FOR IMPLEMENTING ELECTROPHOTOGRAPHIC LAYERED MANUFACTURING OF THREE DIMENSIONAL (3D) OBJECTS, PARTS AND COMPONENTS USING TRI-LEVEL ELECTROPHOTOGRAPHY

BACKGROUND

1. Field of the Disclosed Embodiments

This disclosure relates to systems and methods for implementing a unique electrophotographic layered manufacturing scheme for creating higher fidelity electrophotographic composite laminate layers using tri-level electrophotography as a process for rendering individual laminate layers to be built up to form and/or manufacture three-dimensional objects, parts and components (3D objects).

2. Related Art

Traditional object, part and component manufacturing processes, which generally included varying forms of molding or machining of output products, have expanded to include commercial implementations of a new class of techniques globally referred to as "additive manufacturing" or AM techniques. These AM techniques generally involve processes, alternatively referred to as "Solid Freeform Fabrication (SFF)" or "3D printing" in which layers of additive materials, sometimes toxic or otherwise hazardous in an unfinished state, are sequentially deposited on an in-process 3D object according to a particular material deposition and curing scheme. As each layer is added in the 3D object forming process, the new layer of material is added and adhered to the one or more already existing layers. Each AM layer may then be individually cured, at least partially, prior to deposition of any next AM layer in the 3D object build process. This sequential-layer material addition/joining throughout a 3D work envelope is executed under automated control of varying levels of sophistication.

AM (or 3D printing) techniques often employ one or more processes that are adapted from, and appear in many respects to be similar to, well-known processes for forming two-dimensional (2D) printed images on image receiving media substrates. The significant differences in the output structures produced by the 3D printing techniques are generally based on (1) a composition of the deposited materials that are used to form the output 3D objects from the AM device/system or 3D printer; and (2) a number of passes made by the printing systems in depositing comparatively large numbers of successive layers of the deposition material to build up the body of material to the form of the output 3D objects.

An expanding number of AM or 3D printing processes and techniques are now available. Principal distinguishing characteristic between the multiplicity of these AM or 3D printing processes are in the manner in which the layers are deposited to create the output 3D objects, and in the materials that are used to form the output 3D objects.

Certain of the AM techniques (as this term will be used throughout the balance of this disclosure to refer to various 3D object layering and build techniques including 3D printing) melt or soften materials to produce the build layers using techniques such as, for example, selective laser melting or sintering of an input material. Others of the AM manufacturing techniques deposit and cure liquid materials using technologies for the deposition of those liquid materials such as jetted (ink) material "printing" techniques.

Examples of existing AM techniques include those generally referred to as Fused Deposition Modelling (FDM) and Multi-Jet Modelling (MJM). These techniques are being increasingly adopted for prototyping and short run manufacturing of 3D objects. AM techniques like FDM are, for example, capable of building 3D objects from many different common thermoplastic resins that are extrudable. AM techniques like MJM are, for example, capable of building 3D objects by depositing additive materials, including the same thermoplastic resins and other solids components, suspended in pigmented and unpigmented ink-like solutions. The 3D object is built up layer-by-layer by deposition of extruded resin droplets in FDM, or otherwise according to the deposition of jetted material droplets in MJM. As industrial and other applications emerge that attempt to capitalize on the flexibility incumbent in the applications of these and other AM technologies, adaptation of a broader range of techniques is being pursued to potentially exploit advantages in these adaptations from other 2D printing methods.

SUMMARY

AM 3D objects can be formed in shapes that may be very difficult to otherwise render in, for example, a molding or machining manufacture process. Certain of the 3D object intricacies available from implementing these technologies, particularly in the extruded or jetted liquid droplet deposition processes, present other challenges in implementation. Typically, if there exists an overlying feature that would be supported only below it by, for example, air, some manner of support structure often in the form of a second support material, or sacrificial feature formed of a waste material, may be delivered/provided, to hold the overlying structure up in space during the 3D object build process.

A number of powder-based AM techniques have been commercialized. These include Selective Laser Sintering (SLS), as well as certain adaptations of toner-based 2D printing technologies for 3D printing. Those of skill in the art recognize that, in certain of these implementations, no separate support structures are typically required to support the creation of certain complex shapes. In certain of these processes, powdered materials are selectively consolidated into 3D objects with excess powder being manually removed. In an SLS process, for example, a thin layer of powder is deposited in a workspace container and the powder is then fused together using a laser beam that traces the shape of the desired cross-section. The process is repeated by depositing layers of powder thus building the 3D object in this manner layer by layer. In a typical toner-based 3D printing process, a binder material selectively binds powder deposited in layers in a printing technology used to generally print the binder in a shape of a cross-section of the 3D object on each layer of powder.

A 2004 ASME article by Ashok V. Kumar and Anirban Dutta introduced a process for Electrophotographic Layered Manufacturing. The Kumar et al. layered manufacturing process adapts an electrophotographic 2D image forming technique for 3D object forming in which powdered toner particles are "picked up and deposited using a charged photoconducting surface and deposited layer by layer on a build platform." See Abstract of Kumar et al. Kumar et al. designed and constructed a test bed to demonstrate the feasibility of precise toner deposition to render a 3D object by printing powdered toner layer by layer in an eletrophotographic printing process. Kumar et al. described a powdered-toner based freeform fabrication technology that builds 3D objects by printing powder layer by layer in shapes of cross-sections of the 3D object using the same electrophotographic image forming technology that is widely used in laser printers and photocopiers. Kumar et al. explains that powdered toner "can be printed in the required shape with high precision and resolution."

The concepts introduced in Kumar et al. were further developed and refined. U.S. Pat. No. 8,879,957 to Hanson et al., entitled "Electrophotography-Based Additive Manufacturing System With Reciprocating Operation," is directed to "an additive manufacturing system for printing a three-dimensional part using electrophotography." The Hanson et al. AM system includes a known rotatable photoconductor component, multiple development stations configured to develop layers of materials on a surface of the rotatable photoconductor component while the rotatable photoconductor component rotates in opposing rotational directions, and a platen configured to operably receive the developed layers in a layer-by-layer manner to print the three-dimensional part from at least a portion of the received layers. See Abstract of Hanson et al.

As discussed in Hanson et al., electrophotography or xerography is a known technology for forming 2D images on image receiving media substrates of varying compositions. Electrophotographic image forming systems include a photoconductor element that may be in a form of a conductive support drum coated with a photoconductive material layer. Latent electrostatic images are formed on the photoconductive surface by charging and then image-wise exposing (discharging) the photoconductive layer using an optical imaging source. The latent electrostatic images are then moved to a developing station where toner is applied to charged areas of the photoconductive layer to form toner (visible) images thereon. The formed toner images are then transferred to intermediate transfer components for further transfer to the image receiving media substrates, or otherwise transferred directly to the image receiving media substrates at an image transfer nip. The image receiving media substrates to which the toner images have been transferred are then passed to downstream device components where the toner images are fixed or fused to the image receiving media substrates through the application of heat and/or pressure. See, e.g., col. 1, lines 50-62 of Hanson et al.

The adaptation of this process by the Hanson et al. systems and methods for 3D object forming are particularly described as follows. The Hanson et al. system includes a rotatable photoconductor component, a first development station and a second development station. The first development station is configured to develop a layer of a first material on the surface of the photoconductor, and the second development station is configured to develop a layer of a second material on the surface of the photoconductor. Hanson et al. includes a rotatable intermediate transfer component configured to receive the multiplicity of developed layers transferred from the surface of the photoconductor. Hanson et al. then includes a build platform that is in a form of a platen configured to receive the developed layers from the intermediate transfer component in a layer-by-layer manner to print the 3D object in the Hanson et al. AM process. The index of the platen along a z-axis is adjusted between layer depositions in the build process. See generally col. 2, lines 1-25 of Hanson et al.

Hanson et al. specifies that one of the first and second development stations delivers what the disclosure refers to as "part" material and the other one of the first and second development stations delivers what the disclosure refers to as "support" material. Hanson et al. explains that part material and support material may be printed in layers. The Hanson et al. support structure may, for example, include one or more structures printed to provide vertical support along the z-axis for overhanging regions of any of the layers of 3D object (part). Hanson et al. explains that this allows a 3D object to be printed with a variety of geometries as a processor parses 3D object modeling data to describe a plurality of laminate layer "slices" defining a 3D part and support structure, thereby allowing Hanson et al. system to print a 3D part and support structure in a layer-by-layer manner. See generally col. 3, line 42—col. 4, line 6 of Hanson et al.

In layered electrophotographic AM 3D object forming systems such as that described in Hanson et al., a challenge arises in providing high precision 3D output objects when the part component of any 2D slice laminate layer does not register precisely with the support component. In laser xerography, the 2D image forming process from which the layered electrophotographic 3D object AM process is adapted, when it is important to register one color image next to another color image, color mis-registration as large as 100 to 250 microns can occur due to electro-mechanical complexities in the movements and interactions of components that make up the image forming systems and that are responsible for such image-on-image registration. Such mis-registrations, in a form of overlap of part components of a single layer and support components of that single layer, may similarly arise in systems for performing electrophotographic layered AM when using a support layer and attempting to properly register the support layer component to the part layer component.

In view of the above known concern with regard to certain registration inaccuracies, it would be advantageous to develop an advanced layered electrophotographic AM 3D object forming system and/or technique that provides significantly increased piece part accuracy of electrophotographic layer AM 3D objects by introducing a process that enables a substantially perfectly registered part layer component relative to a support layer component in each xerographically formed 2D slice laminate for building the 3D object.

Exemplary embodiments of the systems and methods according to this disclosure may provide advanced AM techniques that address the in layer mis-registration shortfall in the conventional electrophotographic AM techniques producing significantly increased piece part accuracy over comparable currently-available techniques and technologies for 3D object forming.

Exemplary embodiments may implement using a tri-level electrostatic process that enables a substantially perfect registration of the part material component side-by-side, i.e., with no overlap, for creating finished 3D objects from a series of correctly registered 2D slices (laminates).

In embodiments, a near net shape 3D volume may be formed of a completed set of stacked and adhered 2D slices or laminate layers formed to include part layer components and support layer components.

In embodiments, the thus-formed near net shape 3D volume may be refined to a final finished (volumetric) geometry for the 3D object by machining off limited excess material from the slightly oversized 2D slice laminate layers, and removing support material components from the near net shape 3D volume using one or more common surface shaping or material removal (subtractive manufacturing) techniques, with for example a multi-axis Computer Numerical Control (CNC) milling machine or cutter.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for implementing a unique electrophotographic layered manufacturing scheme for creating higher fidelity electrophotographic composite laminate layers using tri-level electrophotography as a process for rendering individual laminate layers to be built up to form and/or manufacture 3D objects, according to this disclosure, will be described, in detail, with reference to the following drawings, in which.

DETAILED DESCRIPTION OF EMBODIMENTS

Figure 1:
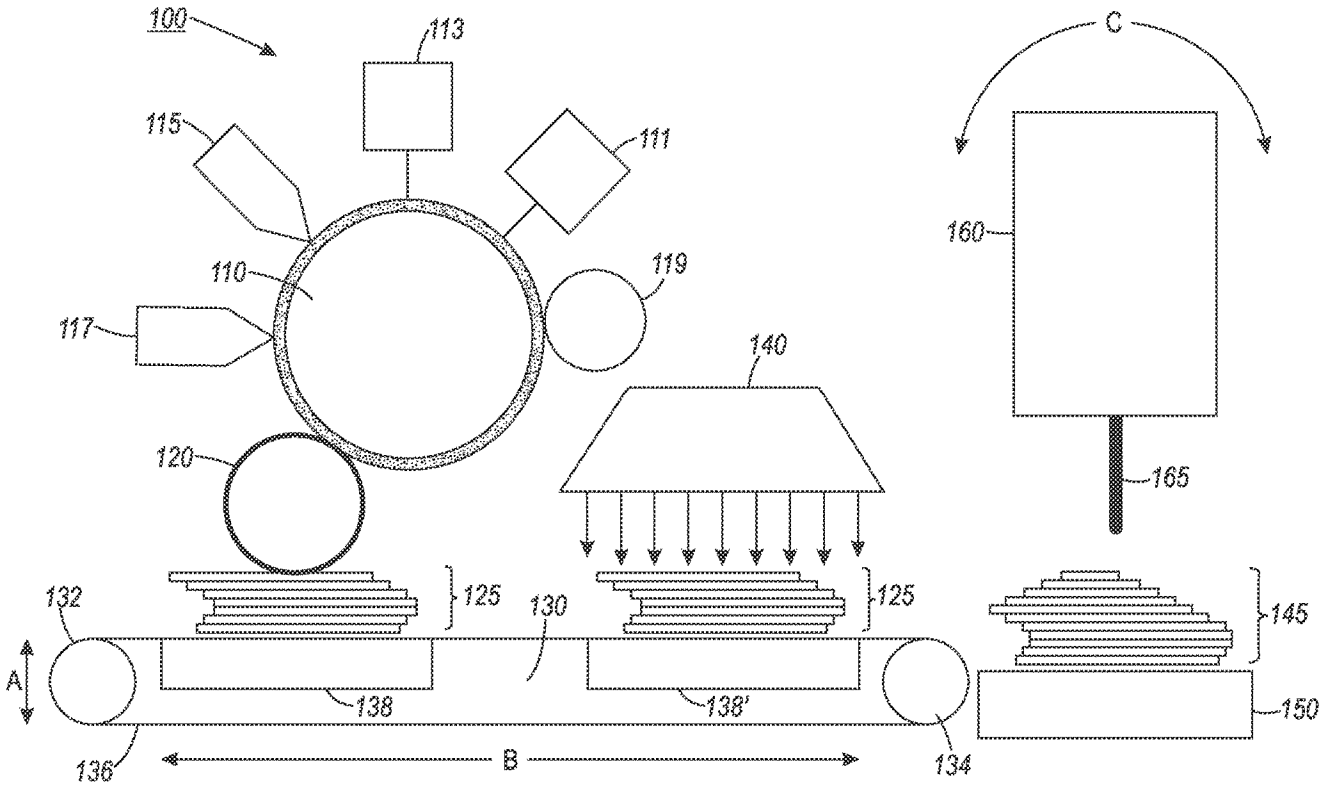
FIG. 1 illustrates a schematic diagram of an exemplary AM 3D object forming system according to this disclosure.

The systems and methods for implementing a unique electrophotographic layered manufacturing scheme for creating higher fidelity electrophotographic composite laminate layers using tri-level electrophotography as a process for rendering individual laminate layers to be built up to form and/or manufacture 3D objects according to this disclosure will generally refer to these specific utilities for those systems and methods. Exemplary embodiments described and depicted in this disclosure should not be interpreted as being specifically limited to any particular configuration of (1) an AM 3D object forming system or components thereof, (2) individual materials for forming part layer components and/or support layer components in each of a plurality of 2D slice laminate layers (2D slices) formed using a tri-level electrostatic (xerographic ore electrophotographic) process, or (3) control and/or processing components for controlling an AM 3D object forming process within the AM system. It should be recognized that any advantageous use of schemes for applying a tri-level electrostatic to reduce in layer composite material side-by-side image registration errors, and thus overall build errors in an output 3D object, employing devices and methods such as those discussed in detail in this disclosure is contemplated as being included within the scope of the disclosed exemplary systems and methods.

The disclosed systems and methods will be described as being particularly adaptable to use for implementing AM techniques by presenting separate materials in a side-by-side layer forming scheme that includes part component elements and support component elements to be registered in individual 2D slice layers. It is recognized that, although described as having 2D slices produced according to the disclosed tri-level electrostatic image forming process, these 2D slices are recognized as having a particular thickness in the third (height or z). Multiple input materials, and potentially variations in the 2D slice layer thicknesses, may be employed in the forming of a single 3D object according to the disclosed AM schemes.

Further, although reference may be made to part layer components and support layer components including certain materials, these references are intended to be illustrative of exemplary materials that could be employed in the disclosed AM schemes. These references should not be considered as limiting the disclosed systems and methods to any particular set or class of input materials other than that they may be presentable in generally powdered form as, for example, toner particles, in the electrostatic marking component of the disclosed systems. Suitable materials for part material may vary depending on the desired part properties. Suitable thermoplastic resins may be adaptable as the part material, including one or more of polyolefins, polyester, nylon, toner materials (e.g., styrene-acrylate/acrylic materials). In embodiments, the part material may also include a carrier material with the thermoplastic resin(s). For example, the carrier material may be magnetically permeable and appropriately coated with a material to triboelectrically charge the thermoplastic resin(s) of part material. Suitable materials for support material may also vary depending on the desired support structure properties, such as one or more thermoplastic resins that are compatible with the selected part material, and that may be easily separated from 3D object after the AM 3D object forming process is complete (e.g., the support material may have a different solubility, a different melting temperature, and the like). Here too, the support material may include a carrier material with the thermoplastic resin(s). For example, the carrier material may be magnetically permeable and appropriately coated with a material to triboelectrically charge the thermoplastic resin(s) of part material. In an alternative example, the carrier material may be coated with the thermoplastic resin(s) of support material. Generic reference will be made to output 3D objects in order that this disclosure is not interpreted as being particularly limited to any AM 3D object forming techniques for producing a particular output 3D object.

The disclosed embodiments are intended, among other objectives, to provide a comparatively more precise piece part forming of 3D objects formed in an AM process by minimizing in layer mis-registration between part layer components and support layer components both registered in a single 2D slice layer formed in an electrostatic process.

FIG. 1 illustrates a schematic diagram of an exemplary AM 3D object forming system 100 according to this disclosure. As shown in FIG. 1, the exemplary system 100 may include a photoreceptor 110. In the exemplary embodiment shown in FIG. 1, the photoreceptor 110 may be in the form of a drum having a solid core with a photoconductive surface formed on an outer surface of the drum. The disclosed systems and methods should not be considered as being limited to a drum-type photoreceptor component. Other typical photoreceptor configurations, including, for example, belts, may be substituted in the exemplary system 100 shown in FIG. 1.

The exemplary system 100 may include some manner of cleaning component 119 which may be brought into contact with the photoconductive surface of the photoreceptor 110 between individual imaging operations in order to clean and condition the photoconductive surface.

The photoconductive surface of the photoreceptor 110 may be charged with input from a charging device (or charge inducing device) 111 in a manner typical to electrostatic and/or xerographic image forming devices. This operation is intended to impart a substantially uniform electrostatic charge on the photoconductive surface of the photoreceptor 110.

The exemplary system 100 may include an optical imaging unit 113 that may be digitally controlled and employed to selectively expose the charged photoconductive surface of the photoreceptor 110 to electromagnetic radiation in a manner that causes individually-pixelated locations on the photoconductive surface to be selectively discharged in a manner that generates a latent image on the photoconductive surface of the photoreceptor 110. The optical imaging unit 113 may be in a form of a laser light source, a light emitting diode (LED) array, or other similar optical/light exposure device. Different from typical electrophotographic or xerographic image forming, the disclosed systems and methods may employ what is referred to as a tri-level electrostatic or electrophotographic image forming scheme. This scheme will be described in greater detail below, and with particular reference to FIG. 2 indicating that essentially what occurs is, on a single pass, three separate discharge levels are achieved on the photoconductive surface. A first discharge level may correspond to a background voltage and two other discharge levels may correspond to separate and distinct image voltages directed at separate and distinct side-by-side image portions by which a multi-component latent image is formed on the photoconductive surface of the photoreceptor 110, again on a single pass.

The exemplary system 100 may include at least two developer stations 115, 117 housing two separate developer materials in a form of, for example, first and second toner particles having a substantially same average particle size (or diameter) and being charged at different material bias levels. The at least two developer stations 115, 117 may be configured to deliver metered amounts of the first and second charged toner particles to different appropriately, and separately, charged/discharged portions of the latent image developed on the photoconductive surface of the photoreceptor 110. In this manner, a multi-component toner image may be formed, having substantially perfect registration between the multiple components of the toner image, thereby rendering a substantially uniform height toner image layer on the photoconductive surface of the photoreceptor 110. According to the disclosed process, the first and second toner particles may constitute suitable separate materials for a part component material and a support component material that may vary depending on the desired part component and support component properties. The first and second toner particles may, for example, be comprised of suitable thermoplastic resins for the part component material and the support component material, including polyolefins, polyester, nylon, toner materials (e.g., styrene-acrylate/acrylic materials), and combinations thereof.

The exemplary system 100 may include an intermediate transfer member 120 that may be usable to transfer the multi-component toner image, as a 2D slice in an AM 3D object build process from the photoconductive surface of the photoreceptor 110 to a build platform 138 on which a stack of previously-processed 2D slices 125 may already constitute a partial in-process 3D object.

The build platform 138 may be translatable in a direction B between an image transfer position opposite the intermediate transfer device 120, and a fixing/fusing position (depicted as 138') opposite a fusing device 140 that may employ heat and/or pressure to fuse or otherwise fix each subsequent 2D on the stack of previously-processed 2D slices 125 constituting the in-process 3D object. The build platform 138 may be translatable in direction B using, for example, a conveyor transport system 130 or other comparable transport system, including but not limited to, a robotic arm-type material transport device. The conveyor transport system 130, as depicted in FIG. 1, may comprise a series of conveyor rollers 132, 134 about which a conveyor belt 136 may be made to circulate. The conveyor transport system 130 may have elements that are movable vertically in direction A in order to accommodate the build process of the in-process 3D object with the disposition of each subsequent 2D slice on the stack of 2D slices 125. The conveyor transport system 130 may be usable to cycle the stack of 2D slices 125 back and forth between the image transfer position and the fixing/fusing position to accommodate the transfer and fixing of each subsequent 2D slice in the build process.

The exemplary system 100 may operate under the control of a processor or controller 180. Object forming information may be input regarding a 3D model that is to be built from the set of 2D slices (laminates) printed and processed by the exemplary system 100. The controller 180 may be provided with 3D object forming data that is devolved, or parsed, into component data to execute a controllable process in which individual 2D slices are imaged on the photoconductive surface of the photoreceptor 110. Individual 2D slice templates, in plan form, may be slightly oversized to the finished outer volume of the in-process 3D object at the level of that individual 2D slice layer in the 3D object build process. For many interesting and/or complex parts, the disclosed schemes may separately and accurately pre-form the essentially-finished 2D slices to be separately joined together to render the 3D object.

When the near net volume of the in-process 3D object is complete with the printing, transferring and fixing of the last 2D slice, the near net volume 3D object may then be transported via any known material transport mechanism in direction B from the object build platform to a separate processing station constituting a 3D object finishing station in the exemplary system 100. The 3D object finishing station may include, for example, a finishing platform 150 opposite a multi-axis articulated finishing device 160. The multi-axis articulated finishing device 160 may be, for example, a processor-controlled six axis CNC milling machine with a milling bit 165 for creating a final 3D object shape from a final in-process 3D object (stack of fixed slices) 145 in a minimally subtractive machining process, or other like machining device. The finishing device 160 may be movable in directions A, B and/or C in cooperation with movement of the finishing platform 150, potentially in directions A and B, each controlled by inputs from the controller 180, to finish the in-process 3D object by removing the support material, and potentially surface finishing the in-process object, before outputting the finished 3D object to a material object output area or receptacle. The finishing device 160 may operate on a completed stack of 2D slices as an in-process 3D object 145 on the finishing platform 150 in a finishing process that reduces an outer mold line of the stack of 2D slices, which represents a slightly oversized version of the final 3D object, to the final outer mold line of the manufactured 3D object.

The exemplary system 100 may address the challenge in electrophotographic layered manufacturing in failing to achieve high precision piece part builds when the part layer component may not register precisely with the support layer component conventional electrophotographic or xerographic layer development. In 2D laser xerography, even when it is important to register one color image precisely next to another color image, color mis-registration as large as 100 to 250 microns can occur due to myriad factors, including electro-mechanical complexities in the xerographic systems responsible for such registration. This mis-registration may more detrimentally manifest in an electrophotographic layered AM process when using a support layer and attempting to properly register the support layer to the part layer. The exemplary system 100 may be operated to significantly increase the piece part accuracy of the electrophotographic AM formed 3D objects by effecting the tri-level electrostatic process to substantially perfectly register the part layer component relative to the support layer component in a single layer formed of the multiple components on each layer forming pass.

Conventional laser electrophotographic processes may not provide precise enough layer formation to provide the precision in those layers to effect multiple layer builds that are appropriately precise overall. The conventional processes, as is generally known, rely on charging a photoconductive surface with a substantially negative charge to form the white level background of a print image. A light source selectively discharges portions of the photoconductive surface to a relative positive charge level thus forming the latent image. A toner source with a relative negative polarity is then presented to the relative more positive latent image to induce development of the image on the selectively-discharged photoconductive surface.

The disclosed schemes modify those conventional schemes by implementing a particular and unique type of xerographic solution that overcomes the shortfalls in the conventional schemes in an unforeseeable manner. Tri-level xerography provides substantially perfect registration between two layer components next to each other in a singularly-formed layer. The disclosed schemes that implement this electrophotographic process for building layers in a height direction of the print.

The differences between tri-level xerography and current (conventional) multi-material xerography are captured substantially as follows. There may exist difficulties with registration of the separate materials according to the conventional methods, and if the registration is off, there is overlap in the part and the support layer such that two levels of toner, one on top of the other, may be produced when it was intended to put them one next to another in an image next to image process. In the 3D object forming process, where the intent is to build layer on layer, if this intra-layer registration is off even minimally, and a 3D object is formed of, for example, thousands of layers in thickness the registration error will detrimentally compound rendering an unacceptable output 3D object. When the support layer is necessary for higher quality and/or taller or thicker 3D objects (parts), the additional support layer image must be registered to (next to) the part layer image in conventional electrostatic image forming using tandem color registration techniques common in color xerographic printers. Registering the support layer to the part layer is critical to improved accuracy but will often be unable to overcome the electro-mechanical inaccuracies common to tandem color registration printing, and cause, therefore, the part accuracy to be compromised.

Figure 2:
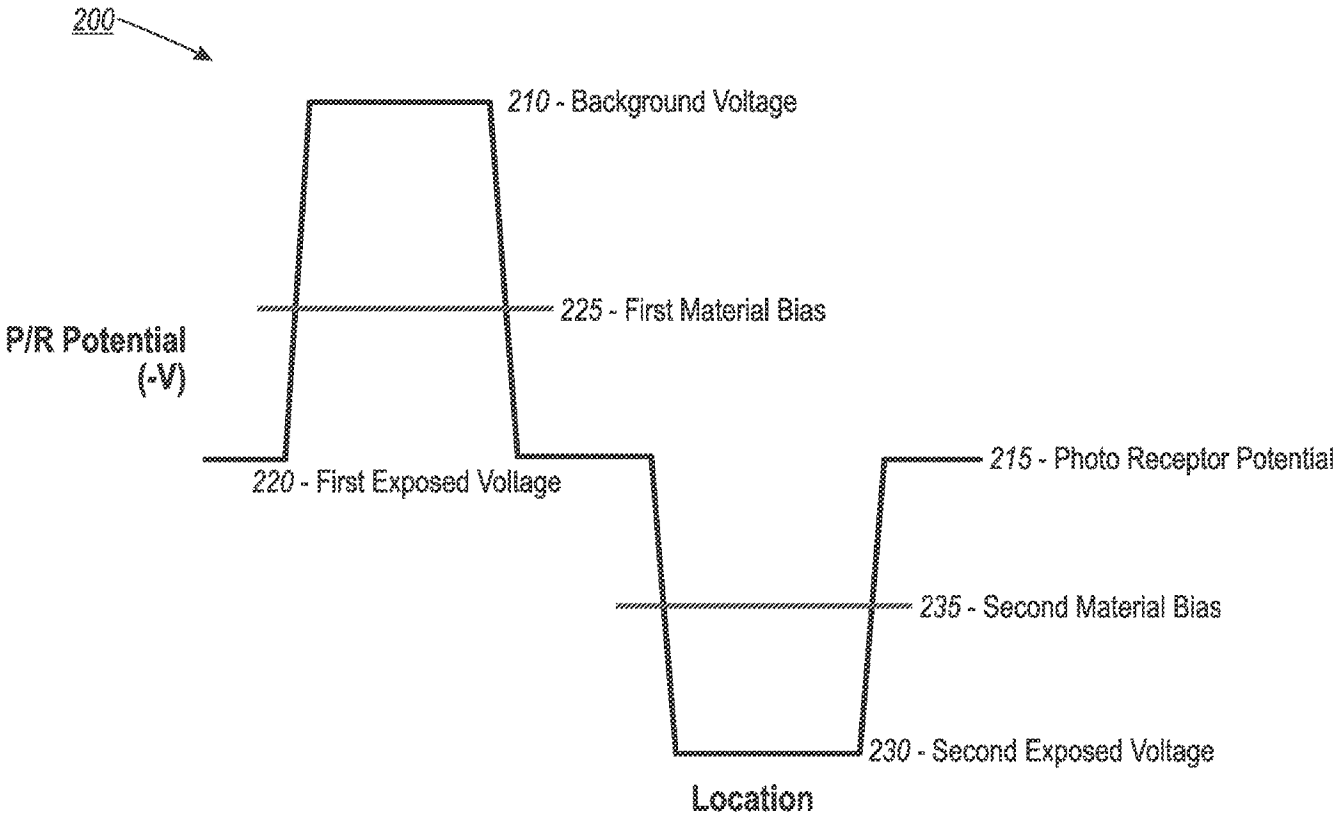
FIG. 2 illustrates a graphical display of an implementation of a tri-level electrophotographic layer forming scheme usable by the systems and methods according to this disclosure.

FIG. 2 illustrates a graphical display 200 of an implementation of a tri-level electrophotographic layer forming scheme usable by the systems and methods according to this disclosure to achieve higher quality registration in overcoming the above-discussed difficulty. As shown in FIG. 2, the tri-level electrophotographic process relies on the initial substantial negative charge on the photoconductive surface (to modify a photoreceptor potential 215) and it is discharged to three different levels. One level will correspond to a background voltage 210 and two areas will correspond to image voltages, first exposed voltage 220 and a second exposed voltage 230. Using charged particles of positive and negative polarity (at a first material bias 225 and a second material bias 235), relative to the exposed voltage levels created, two of the areas with image voltages will proceed to be made visible by developing the latent images into toner images. Because, according to these tri-level schemes, a single imager is used to produce these latent images at two different exposed voltages, the first toned image and the second toned image layer will be substantially perfectly registered in an image next to image registering.

This process can be extended to move charged particles of two substantially different materials on a photoconductive surface with the intention of depositing to an intermediate image transfer member and then to, for example, a build station to form a layer comprised of the two complementary materials and form a two dimensional image on the build station. This process will produce a two color image represented by two distinct materials. The process can be repeated by recharging the photoconductive surface, modifying the charge level on the photoconductive surface to form a new image, developing this new image and transferring this new image to the previous image on the build station.

This process will allow two dissimilar materials, charged particles, to be placed at high accuracy relative to one another in a layer fashion. The layering of these multi-component particle-formed may build the images away from the transfer station and would have a three dimensional appearance. Other steps will also be needed to fix each layer on the build station and to charge this layer appropriately to accept the next layer. One kind of particle would be a permanent part layer, and the other kind of particle would be a temporary support layer.

Tri-level xerography provides a capacity to substantially absolutely guarantee that a material overlap phenomenon between a part layer and a support layer does not occur in that tri-level xerography provides for substantially perfect side-to-side registration. In 3D object forming, in a situation where it is proposed to build up layers of part (structural) material adjacent to a support material, for example. In general in 3D printing applications, this support material may be used to prevent the structural material from bleeding outside a particular boundary, or otherwise spreading on a surface of underlying layers. As these layers are built up, each next tri-level layer must be properly registered to the previous layers.

Figure 3:
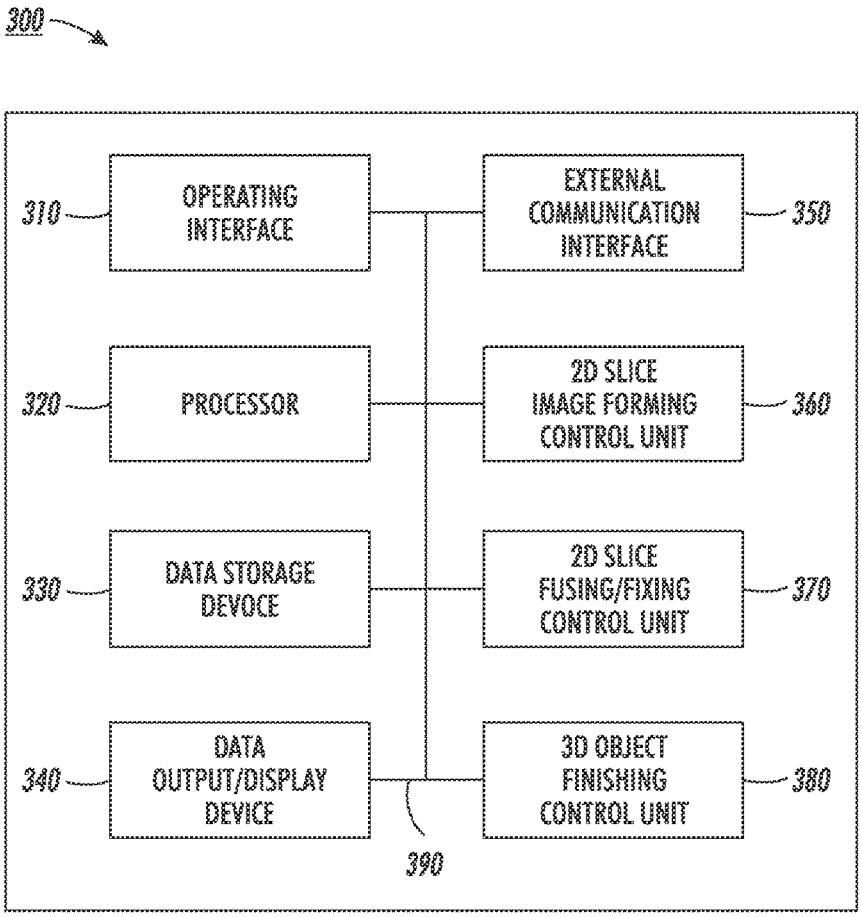
FIG. 3 illustrates a block diagram of an exemplary control system for implementing an AM 3D object forming scheme implementing a tri-level electrostatic process for 2D slice forming for building up an in-process 3D object according to this disclosure.

FIG. 3 illustrates a block diagram of an exemplary control system 300 for implementing an AM 3D object forming scheme implementing a tri-level electrostatic process for 2D slice forming for building up an in-process 3D object according to this disclosure. The exemplary control system 300 may provide input, to or be a component of a controller for executing the AM 3D object forming process in a system such as that depicted in FIG. 1.

The exemplary control system 300 may include an operating interface 310 by which a user may communicate with the exemplary control system 300. The operating interface 310 may be a locally-accessible user interface associated with an AM 3D object forming device. The operating interface 310 may be configured as one or more conventional mechanism common to control devices and/or computing devices that may permit a user to input information to the exemplary control system 300. The operating interface 310 may include, for example, a conventional keyboard, a touchscreen with "soft" buttons or with various components for use with a compatible stylus, a microphone by which a user may provide oral commands to the exemplary control system 300 to be "translated" by a voice recognition program, or other like device by which a user may communicate specific operating instructions to the exemplary control system 300. The operating interface 310 may be a part or a function of a graphical user interface (GUI) mounted on, integral to, or associated with, the AM 3D object forming device with which the exemplary control system 300 is associated.

The exemplary control system 300 may include one or more local processors 320 for individually operating the exemplary control system 300 and for carrying into effect control and operating functions for AM 3D object forming, and specifically for implementing a tri-level electrophotographic layer forming scheme. Processor(s) 320 may include at least one conventional processor or microprocessor that interpret and execute instructions to direct specific functioning of the exemplary control system 300, and control of the AM 3D object forming process with the exemplary control system 300.

The exemplary control system 300 may include one or more data storage devices 330. Such data storage device(s) 330 may be used to store data or operating programs to be used by the exemplary control system 300, and specifically the processor(s) 330. Data storage device(s) 330 may be used to store information regarding, for example, one or more 3D object models for producing 3D objects in an AM 3D object forming device with which the exemplary control system 300 is associated. The stored 3D object model information may be devolved into data for the printing of a series of slightly oversize 2D slices for forming the 3D object in the manner generally described above.

The data storage device(s) 330 may include a random access memory (RAM) or another type of dynamic storage device that is capable of storing updatable database information, and for separately storing instructions for execution of system operations by, for example, processor(s) 320. Data storage device(s) 330 may also include a read-only memory (ROM), which may include a conventional ROM device or another type of static storage device that stores static information and instructions for processor(s) 320. Further, the data storage device(s) 330 may be integral to the exemplary control system 300, or may be provided external to, and in wired or wireless communication with, the exemplary control system 300, including as cloud-based data storage components.

The exemplary control system 300 may include at least one data output/display device 340, which may be configured as one or more conventional mechanism that output information to a user, including, but not limited to, a display screen on a GUI of an AM 3D object forming device with which the exemplary control system 300 may be associated. The data output/display device 340 may be used to indicate to a user a status of an AM 3D object forming operation effected by the device with which the exemplary control system 300 may be associated including an operation of one or more individually controlled components at one or more of a plurality of separate processing stations in the device.

The exemplary control system 300 may include one or more separate external communication interfaces 350 by which the exemplary control system 300 may communicate with components external to the exemplary control system 300. At least one of the external communication interfaces 350 may be configured as an input port to support connecting an external CAD/CAM device storing modeling information for execution of the control functions in the AM 3D object forming operations. Any suitable data connection to provide wired or wireless communication between the exemplary control system 300 and external and/or associated components is contemplated to be encompassed by the depicted external communication interface 350.

The exemplary control system 300 may include a 2D slice image forming control unit 360 that may be used to control the a tri-level electrophotographic layer printing process that produces the series of 2D slices for the in-process 3D object according to devolved 3D object modeling information. The 2D slice image forming control unit 360 may operate as a part or a function of the processor 320 coupled to one or more of the data storage devices 330, or may operate as a separate stand-alone component module or circuit in the exemplary control system 300. Either of the processor 320 or the 2D slice image forming control unit 360 itself may parse the input 3D object model information to determine and execute a layer-by-layer 2D slice material layer printing scheme in the AM 3D object forming device.

The exemplary control system 300 may include a 2D slice fusing/fixing control unit 370 as a part or a function of the processor 320 coupled to one or more of the data storage devices 330, or as a separate stand-alone component module or circuit in the exemplary control system 300. The 2D slice fusing/fixing control unit 370 may be usable to control the functioning of one or more of a heat and/or pressure implemented 2D slice layer fixing process according to known methods derived from 2D xerographic image forming operations to join the individual 2D slices to one another.

The exemplary control system 300 may include a 3D object finisher control unit 380 for executing a final 3D object shaping scheme on a processed stack of cut and joined 2D slices in a subtractive machining process that may remove the layered support component structure and surface finish the 3D object. As with the above-enumerated other separate control units, the 3D object finisher control unit 380 may operate as a part or a function of the processor 320 coupled to one or more data storage devices 330 for executing finishing device operations, or may operate as a separate stand-alone component module or circuit in the exemplary control system 300.

All of the various components of the exemplary control system 300, as depicted in FIG. 3, may be connected internally, and to one or more AM 3D object forming devices, by one or more data/control busses 390. These data/control busses 390 may provide wired or wireless communication between the various components of the exemplary control system 300, whether all of those components are housed integrally in, or are otherwise external and connected to an AM 3D object forming device with which the exemplary control system 300 may be associated.

It should be appreciated that, although depicted in FIG. 3 as an integral unit, the various disclosed elements of the exemplary control system 300 may be arranged in any combination of sub-systems as individual components or combinations of components, integral to a single unit, or external to, and in wired or wireless communication with the single unit of the exemplary control system 300. In other words, no specific configuration as an integral unit or as a support unit is to be implied by the depiction in FIG. 3. Further, although depicted as individual units for ease of understanding of the details provided in this disclosure regarding the exemplary control system 300, it should be understood that the described functions of any of the individually-depicted components, and particularly each of the depicted control units, may be undertaken, for example, by one or more processors 320 connected to, and in communication with, one or more data storage device(s) 330.

Figure 4:
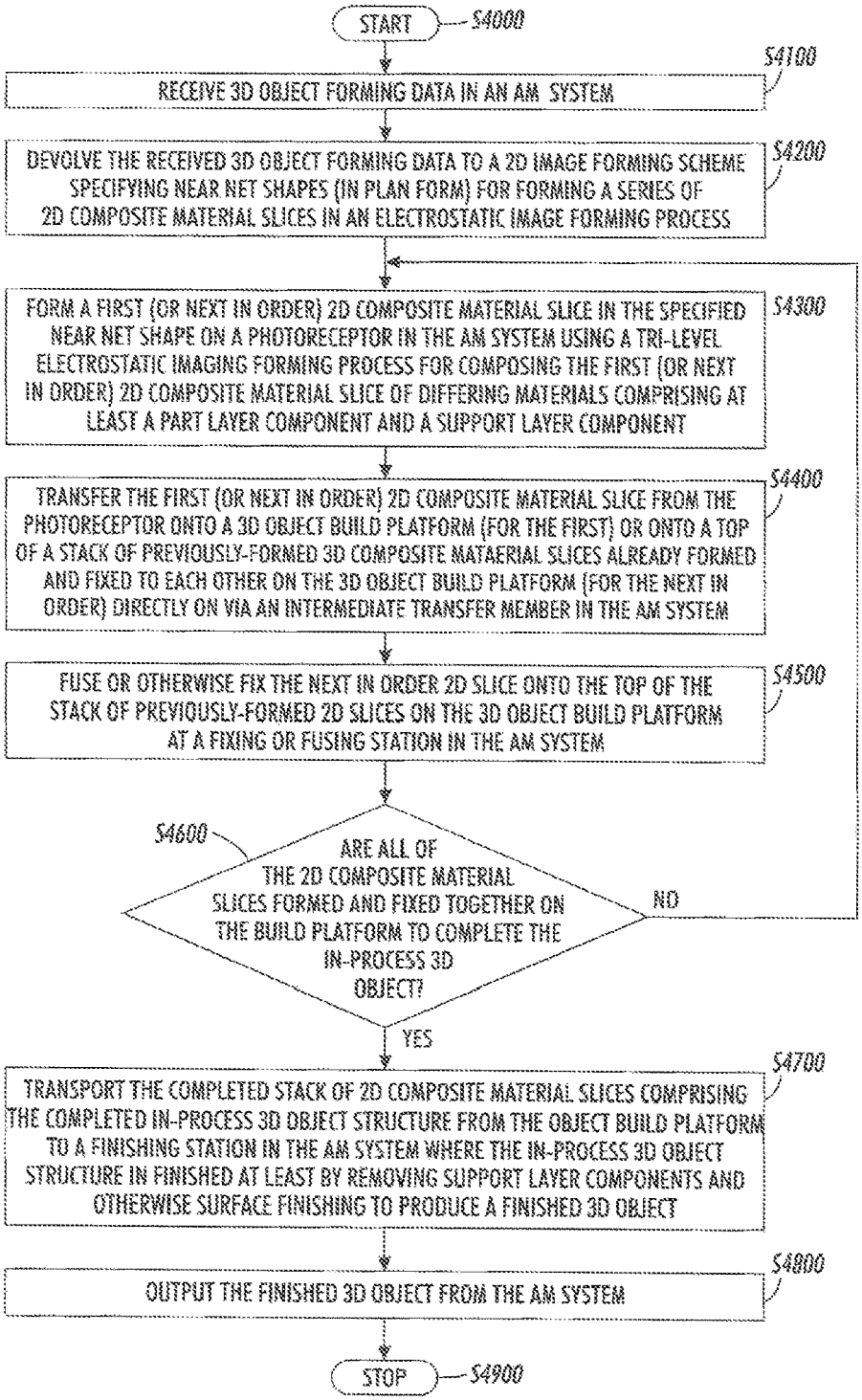
FIG. 4 illustrates a flowchart of an exemplary method for implementing AM 3D object forming scheme implementing a tri-level electrostatic process for 2D slice forming for building up an in-process 3D object according to this disclosure.

The disclosed embodiments may include exemplary methods for implementing an AM 3D object forming scheme using a tri-level electrostatic process for 2D slice forming for building up an in-process 3D object. FIG. 4 illustrates a flowchart of such an exemplary method. As shown in FIG. 4, operation of the method commences at Step S4000 and proceeds to Step S4100.

In Step S4100, 3D object forming data may be received from a data source in an AM 3D object forming system. Operation of the method proceeds to Step S4200.

In Step S4200, the received 3D object forming data may be devolved, parsed or otherwise converted into a 2D image forming scheme. The 2D image forming scheme may specify near net shapes (in plan form) for forming a series of 2D composite material slices in a tri-level electrophotographic or electrostatic image forming process. Operation of the method proceeds to Step S4300.

In Step S4300, a first (or next in order) 2D composite material slice may be formed in the specified near net shape (in plan form) on a photoreceptor in the AM 3D forming system using a tri-level electrophotographic or electrostatic layer forming scheme for composing the first (or next in order) 2D composite material slice of differing materials comprising at least a part layer component and a support layer component. Operation of the method proceeds to Step S4400.

In Step S4400, the first (or next in order) 2D composite material slice may be transferred from the photoreceptor (a) onto a 3D object build platform for the first 2D composite material slice, or (b) onto a top of a stack of previously-formed 2D composite material slices already formed and fixed to each other on the 3D object build platform for a next in order 2D composite material slice, directly from the photoreceptor or via an intermediate transfer member. Operation of the method proceeds to Step S4500.

In Step S4500, the next in order 2D composite material slice may be fused or otherwise fixed to the stack of previously-formed 2D composite material slices already formed and fixed to each other on the 3D object build platform. Operation of the method proceeds to Step S4600.

Step S4600 is a determination step in which it is determined whether all of the 2D composite material slices are formed and fixed together on the 3D object build platform in the AM 3D object forming system to complete the in-process 3D object.

If in Step S4600, it is determined that all of the 2D composite material slices of the in-process 3D object have not been formed and fixed together on the 3D object build platform, operation of the method reverts to Step S4300.

If in Step S4600, it is determined that all of the 2D composite material slices of the in-process 3D object have been formed and fixed together on the 3D object build platform, operation of the method proceeds to Step S4700.

In Step S4700, the completed stack of 2D composite material slices comprising the in-process 3D object may be transported from the 3D object build platform to a finishing station in the AM 3D object forming system. At the finishing station, the in-process 3D object structure may be finished at least by removing support layer components and otherwise surface finishing to produce a finished 3D object. Operation the method proceeds to Step S4800.

In Step S4800, the formed and finished 3D object may be output from the AM 3D object forming system. Operation of the method proceeds to Step S4900, where operation of the method ceases.

As indicated above, the method may positively provide a previously unachievable level of precision in the electrophotographic or electrostatic build process for fabricating a finished output 3D object formed in the AM 3D object forming system.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable operating, product processing, electrophotographic/electrostatic image forming schemes and 3D object forming or AM environments in which the subject matter of this disclosure may be implemented for familiarity and ease of understanding. Although not required, embodiments of the disclosure may be provided, at least in part, in a form of hardware circuits, firmware, or software computer-executable instructions to carry out the specific functions described. These may include individual program modules executed by processors.

Those skilled in the art will appreciate that other embodiments of the disclosed subject matter may be practiced in AM 3D object forming systems and/or devices, including various additive and subtractive manufacturing methods, of many different configurations.

As indicated above, embodiments within the scope of this disclosure may include computer-readable media having stored computer-executable instructions or data structures that can be accessed, read and executed by one or more processors for controlling the disclosed AM 3D object forming schemes. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures for carrying into effect those executable instructions represent one example of a corresponding sequence of acts for implementing the functions described in the steps of the above-outlined exemplary method. The exemplary depicted steps may be executed in any reasonable order to carry into effect the objectives of the disclosed embodiments. No particular order to the disclosed steps of the methods is necessarily implied by the depiction in FIG. 4, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

We claim:

1. An object manufacturing system, comprising:

an laminate forming device for electrostatically forming multi-component laminates, each of a plurality of the multi-component laminates constituting an individual layer among a plurality of layers for forming an in-process three-dimensional (3D) object, the laminate forming device comprising:

a photoreceptor having a photoconductive surface;

a charging device for charging the photoconductive surface of the photoreceptor to a substantially uniform charge level (UCL);

an optical imaging device for forming a tri-level photoconductive surface on the photoreceptor by discharging a first portions of the photoconductive surface to a first image charge level (FICL) and a second portions of the photoconductive surface to a second image charge level (SICL) to form a multi-component latent image on the photoconductive surface of the photoreceptor;

wherein the formed tri-level photoconductive surface comprise UCL, FICL, and SICL levels of discharge;

a first developer station positioned downstream of the optical imaging device in an image forming process direction, the first developer station being configured to deliver a metered amount of first charged toner particles to the discharged first portions of the photoconductive surface to form a first portion of the multi-component laminate; and a second developer station positioned downstream of the first developer station in the image forming process direction, the second developer station being configured to deliver a metered amount of second charged toner particles to the discharged second portions of the photoconductive surface to form a second portion of the multi-component laminate on a same cycle of the photoreceptor;

wherein the UCL, the FICL, and the SICL enables a substantially perfect registration between the multi-component laminates;

a 3D object build platform having a surface configured to receive each of the plurality of the multi-component laminates transferred from the photoreceptor in support of a 3D object build process constituted of the plurality of layers;

a data storage device storing 3D object modeling information;

a processor that is programmed to control forming of each of the plurality of multi-component laminates on the photoconductive surface of the photoreceptor, and to control transferring of the each of the formed multi-component laminates from the photoreceptor to the 3D object build platform as the plurality of layers constituting the in-process 3D object;

the processor being further programmed to reference the 3D object modeling information stored in the data storage device for forming a particular 3D object; and the processor being further programmed to deconstruct the referenced 3D object modeling information to generate individual laminate layer forming data to control the forming of each multi-component laminate on the photoconductive surface of the photoreceptor.

2. The system of claim 1, further comprising layer fixing device that at least one of fuses and fixes second and subsequent ones of the plurality of the formed multi-component laminates to one or more previously-transferred ones of the plurality of the formed multi-component laminates received by the 3D object build platform to form the in-process 3D object, the processor being further programmed to control the at least one of the fusing and fixing.

3. The system of claim 2, the layer fixing device applying at least one of heat and pressure to the each one of the plurality of multi-component laminates forming the in-process 3D object.

4. The system of claim 2, the layer fixing device being offset from the laminate forming device in a 3D object build process direction, the 3D object build platform cycling between a transfer position opposite the photoreceptor and a fixing position opposite the layer fixing device to sequentially receive the transfer of the each subsequent one of the plurality of formed multi-component laminates at the transfer position and to move to the fixing position for the at least one of fusing and fixing of the each subsequent one of the plurality of formed multi-component laminate as a part of the in-process 3D object.

5. The system of claim 4, further comprising a transport device that transports the 3D object build platform between the transfer position and the fixing position, the processor being further programmed to control the transport of the in-process 3D object by the transport device.

6. The system of claim 5, the transport device comprising a conveyor transport system.

7. The system of claim 4, further comprising a finishing device positioned downstream of the layer fixing device in the 3D object build process direction, the finishing device being configured to execute a finishing processing on a completed in-process 3D object in which the plurality of multi-component laminates are formed and fixed together.

8. The system of claim 7, the processor being further programmed to determine when a full set of the plurality of formed multi-component laminates are formed and fixed together to render the completed in-process 3D object;

control a transport of the completed in-process 3D object to the finishing device; and control the finishing device to execute the finishing processing of the completed in-process 3D object to render a finished 3D object.

9. The system of claim 8, wherein:

the first portions of the plurality of the formed multi-component laminates cooperate to form a part portion of the in-process 3D object;

the second portions of the plurality of the formed multi-component laminates cooperate to form a support portion of the in-process 3D object; and the processor is programmed to control the finishing device to execute the finishing processing on the in-process 3D object to remove the support portion and render the finished 3D object.

10. The system of claim 9, the processor being further programmed to control the finishing device to execute a surface finishing processing of the finished 3D object.

* * * * *